US006334793B1

(12) United States Patent
Amoni et al.

(10) Patent No.: US 6,334,793 B1
(45) Date of Patent: Jan. 1, 2002

(54) ENHANCED UNIVERSAL SERIAL BUS

(75) Inventors: Sergio Amoni, Raleigh; Timothy Scott Brookie; Paul Daniel Kangas, both of Cary, all of NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/072,000

(22) Filed: May 4, 1998

Related U.S. Application Data

(62) Division of application No. 08/807,493, filed on Feb. 27, 1997, now Pat. No. 6,086,430.

(51) Int. Cl.[7] ..... H01R 13/64

(52) U.S. Cl. ..... 439/680; 439/660; 439/639; 439/677

(58) Field of Search ..... 439/680, 677, 439/674, 660, 295, 284, 639; 361/752, 728, 796, 786

(56) References Cited

U.S. PATENT DOCUMENTS

| | | | | | |
|---|---|---|---|---|---|
| 3,447,036 | A | * | 5/1969 | Dore et al. | 439/701 |
| 3,491,330 | A | | 1/1970 | Barnhart et al. | 439/677 |
| 4,746,298 | A | | 5/1988 | Hollander | 439/222 |
| 4,764,129 | A | * | 8/1988 | Jones et al. | 439/677 |
| 4,990,099 | A | | 2/1991 | Marin et al. | 439/284 |
| 5,167,542 | A | | 12/1992 | Haitmanek | 439/681 |
| 5,254,019 | A | | 10/1993 | Noschese | 439/681 |
| 5,421,734 | A | * | 6/1995 | MacWilliams | 439/680 |
| 5,593,311 | A | * | 1/1997 | Lybrand | 439/295 |

FOREIGN PATENT DOCUMENTS

| | | | | |
|---|---|---|---|---|
| DE | 3246405 | * | 6/1984 | 439/677 |
| DE | 3625927 | * | 2/1988 | 439/677 |

OTHER PUBLICATIONS

"Multi–Voltage Power Supply/Interface Polarizing Key," *IBM Technical Disclosure Bulletin,* vol. 37, No. 02A, Feb. 1994, pp. 339–340.

* cited by examiner

*Primary Examiner*—Tho D. Ta
(74) *Attorney, Agent, or Firm*—Winstead, Sechrest & Minick, LLP; J. Bruce Schelkopf

(57) ABSTRACT

An enhanced Universal Serial Bus (USB) interface provides for the communication of standard USB signaling and non-standard USB signaling, which may be alternate voltage signals. The chassis within data processing devices operable for receiving such an enhanced USB connector into an enclosed enhanced USB receptacle provide a keying configuration so that the standard USB connector portion is not matable with the non-standard USB portion.

8 Claims, 9 Drawing Sheets

ENHANCED UNIVERSAL SERIAL BUS

CROSS-REFERENCE TO RELATED APPLICATION

This is a divisional of U.S. patent application Ser. No. 08/807,493 filed Feb. 27, 1997 U.S. Pat. No. 6,086,430.

This application for patent is related to co-pending U.S. patent application Ser. No. 08/842,695, which is hereby incorporated by reference herein.

TECHNICAL FIELD

The present invention relates to supplying various voltages and power levels via a standard bus interface. More particularly, it relates to an apparatus for supplying multiple voltages via a Universal Serial Bus compatible interface.

BACKGROUND INFORMATION

Recently, personal computers ("PCs") used a variety of techniques for providing input and output. These included a serial port, usually an RS232, a parallel port and several ISA expansion slots included on the mother board. Connecting the PCs to anything more complicated than a mouse, modem or printer, required the lid to be removed and dip switches to be set and software configured. SCSI (small computer systems interface) permitted access to external storage devices, but required a large cable connector with the need to manually set ID numbers and have a terminator.

Referring to FIG. 1, Universal Serial Bus ("USB") is specified to be an industry standard extension to the PC architecture with a focus on computer telephony interface, consumer and productivity applications. The USB architecture provides for ease of use of peripheral expansion, transfer rates up to 12 megabits per second, protocol flexibility for mixed modes, isochronous data transfers and asynchronous massaging. USB is a cable bus supporting data transfer between the host PC and a range of simultaneously testable peripherals. One host controller can support up to 127 physical devices using a tiered topology. The hub is at the center of each star with each wire segment creating a point-to-point connection of up to 5 meters. The 5 meter limitation may be between a host and a hub or a hub function or a hub connected to another hub or function.

Alternatively, a number of peripherals can be daisy-chained together via the 4-wire USB cable. One of the 4 wires referred to as VBUS provides a DC voltage of +5 volts and another wire provides a ground signal. The USB cable provides power to the devices along the chain. Signaling takes place over two wires between two end points. The signals of each end point are driven differentially over a 90 ohm impedance with each receiver featuring input sensitivity of at least 200 millivolts. A non-return to zero invert (NRZI) with bit stuffing to insure adequate transitions is used to carry the bus clock down the chain. A sync field precedes each data package to allow the receivers to synchronize their bit recovery clocks. The serial interface provides a maximum bandwidth of 12 megabits per second and can connect as many as 127 devices to a host system.

Physically, USB devices ranging from a mouse, joystick to telephones connect to a host via layers of multiport hubs. The requisite hub called "the root hub" is located in the host and can include multiple ports. Hubs linked to USB devices via point-to-point connections. The host views all USB devices as if they connect in a true star arrangement. USB supports both the standard devices that operate a full 12 megabit rate and low end devices that use only a 1.5 megabit sub channel. Hubs must always support 12 megabit operations and must insure that 12 megabit transmissions do not go to 1.5 megabit devices.

USB cables that carry 12 megabit traffic require a shielded twisted pair construction on the signal pair and can be no longer than 5 meters. Low speed cables can be no longer than 3 meters and require no shielding or twisting of the signaling pair. The host uses a master slave protocol to control the bidirectional communications with USB devices. The interface employs a 1 KHZ bus clock that instigates bussing a new frame every 1 millisecond. The interface handles multiple transactions including time critical isochronous transactions within each frame in 1 millisecond period and 12 megabit per second bandwidth limit type of isochronous data streams that the interface can successfully carry.

One problem with the universal serial bus is that it provides only one voltage. Devices that operate at different voltages or have high power requirements are required to supply their own voltage sources and power sources. In some environments, for instance, the retail point-of-sale environment, this additional cabling for power creates a non-aesthetic appearance at the store front.

The co-pending U.S. patent application Ser. No. 08/842,695 cross-referenced above, discloses an enhanced USB interface cable, which provides auxiliary power levels other than the standard USB power levels described previously. A problem with providing such an enhanced USB signaling is that an end-user may attempt to couple a standard USB plug into the enhanced USB receptacle.

SUMMARY OF THE INVENTION

The foregoing problem is addressed by the present invention which provides a unique keying pattern stamped into the system unit enclosure containing the enhanced and standard USB receptacles, which is only matable with a unique cut-out pattern in the shield of the molded plug of the enhanced USB connector. As a result, a standard USB plug is prevented from coupling with an enhanced USB receptacle.

In an alternative embodiment of the present invention, the keying pattern stamped into the system unit enclosure, or chassis, may be configured to permit only a polarized connection to be made with the enhanced USB connector portion.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
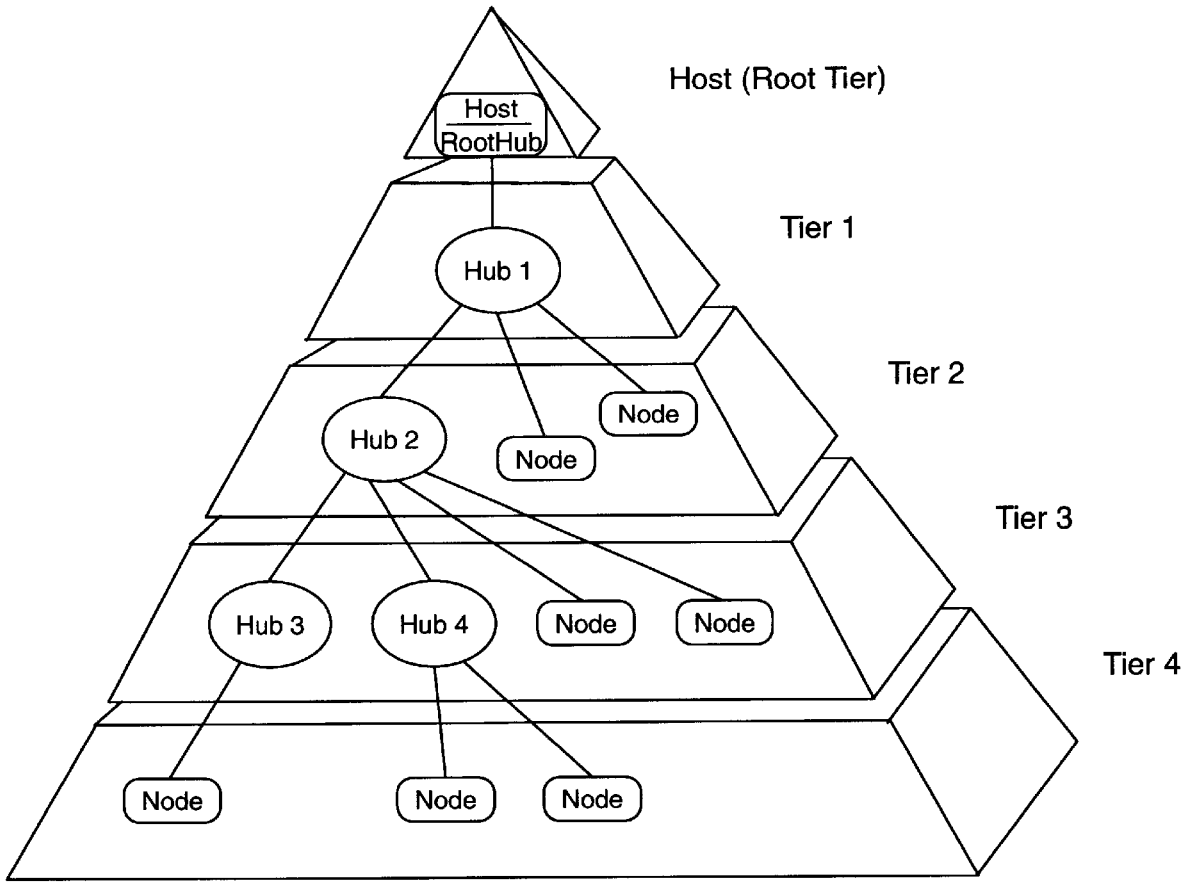
FIG. 1 (Prior Art)
FIG. 1 illustrates an example bus topology for the USB.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

Within the following description, a standard Universal Serial Bus ("USB") connector, receptacle, plug, and signaling all refer to the USB architecture described within the *Universal Serial Bus Specification*, 1.0 Final Draft Revision, Copyright Nov. 13, 1995, which is hereby incorporated by reference herein. USB is a cable bus that supports data exchange between a host computer and a wide range of simultaneously accessible peripherals. The attached peripherals share USB bandwidth through a host scheduled token based protocol. The bus allows peripherals to be attached, configured, used, and detached while the host and other peripherals are in operation. This is referred to as dynamic (or hot) attachment and removal.

FIG. 1 illustrates the topology of the USB. The USB connects USB devices with the USB host. The USB physical interconnect is a tiered star topology. A hub is at the center of each star. Each wire segment is a point-to-point connection between the host and a hub or function, or a hub connected to another hub or function.

There is generally only one host on any USB system. The USB interface to the host computer system is referred to as the host controller. The host controller may be implemented in a combination of hardware, firmware, or software. A root hub is integrated within the host system to provide one or more attachment points.

USB devices include:

hubs, which provide additional attachment points to the USB;

functions, which provide capabilities to the system; for example, an ISDN connection, a digital joy stick, or speakers. USB devices present a standard USB interface in terms of their:

comprehension of the USB protocol;

response to standard USB operations such as configuration and reset;

standard capability descriptive information.

Figure 2:
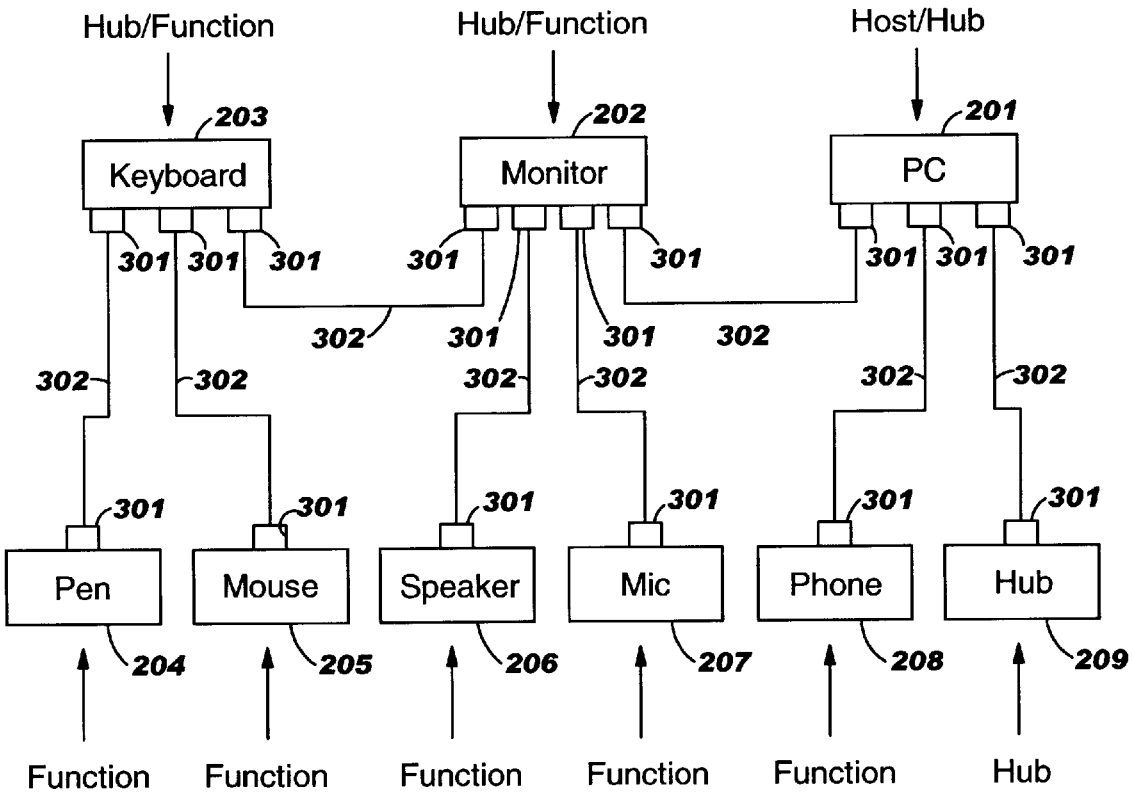
FIG. 2 (Prior Art)
FIG. 2 illustrates hubs in a desktop computer environment using USB interconnections.

Referring next to FIG. 2, there is illustrated a diagram of how hubs provide connectivity in a desktop computer environment. The data processing system shown in FIG. 2 includes computer (PC) 201, monitor 202, and keyboard 203. Coupled to PC 201 are phone 208 and another hub 209. Coupled to monitor 202 are speaker 206 and microphone (MIC) 207. Coupled to keyboard 203 are pen 204 and mouse 205. PC 201 is coupled to monitor 202, which is coupled to keyboard 203. All of the previously noted and shown coupling is via USB buses 302 with USB plug connectors 301.

A function is a USB device that is able to transmit or receive data or control information over the bus. A function is typically implemented as a separate peripheral device with a cable that plugs into a port on a hub. However, a physical package may implement multiple functions and an embedded hub with a single USB cable. This is known as a compound device. A compound device appears to the host as a hub with one or more permanently attached USB devices.

Each function contains configuration information that describes its capabilities and resource requirements. Before a function can be used, it must be configured by the host. This configuration includes allocating USB bandwidth and selecting function specific configuration options.

Figure 3:
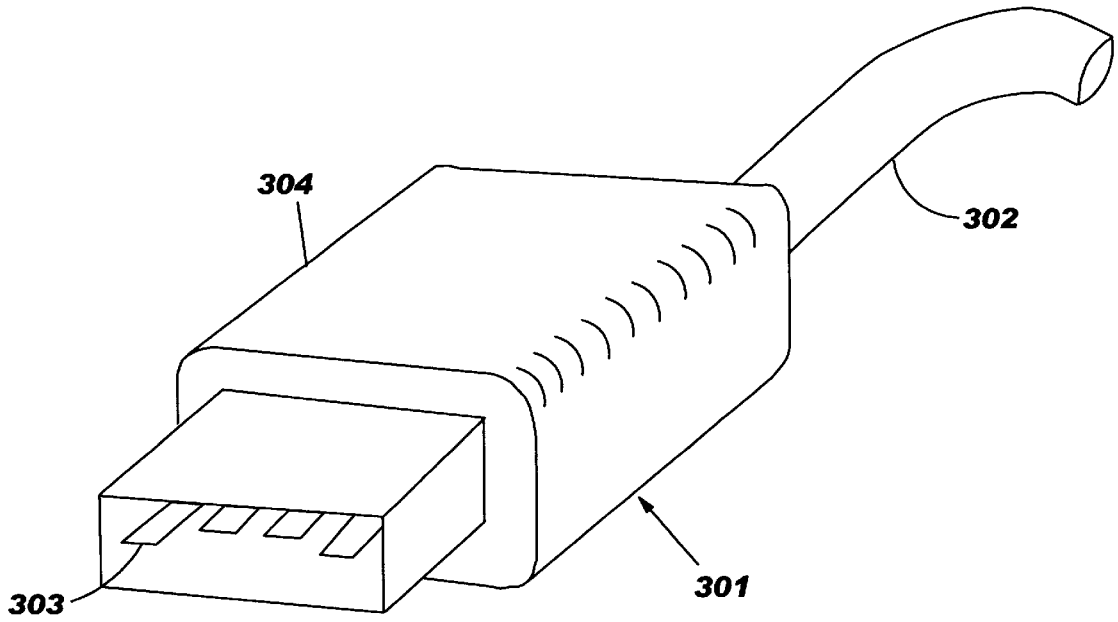
FIG. 3 (Prior Art)
FIG. 3 illustrates a standard USB cable plug.

Referring next to FIG. 3, there is illustrated standard USB cable plug 301 having bus 302 coupled thereto. Plug 301 includes a standard USB shielded plug housing 303, which conforms to the standard USB architecture described in the Universal Serial Bus specification referenced above. Standard USB shielded plug housing 303 operates to communicate differentially driven data signals D+ and D−, a 5-volt signal, and a ground signal.

Figure 5:
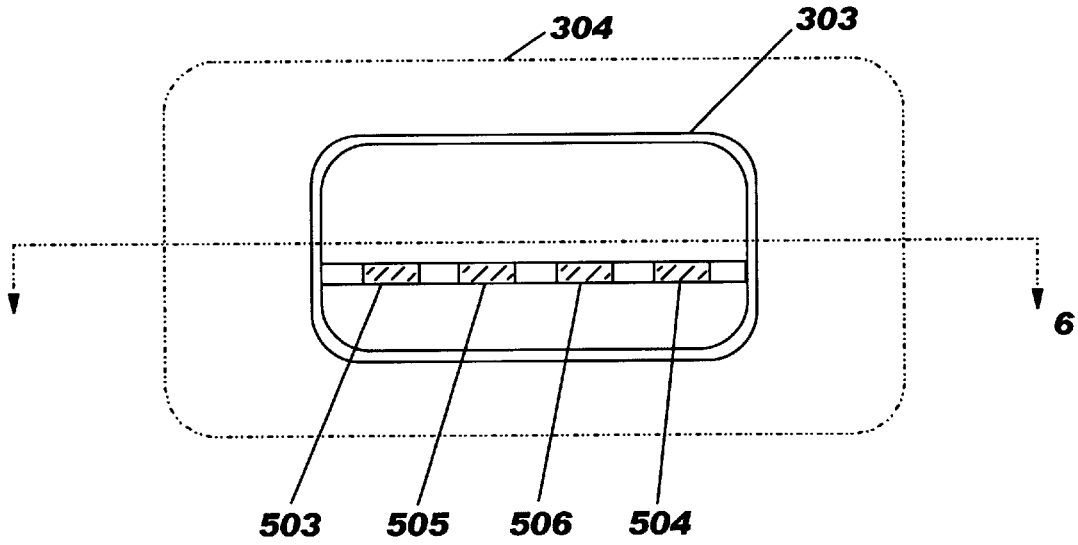
FIG. 5 (Prior Art)
FIGS. 5–7 illustrate various views of a USB interface.
Figure 6:
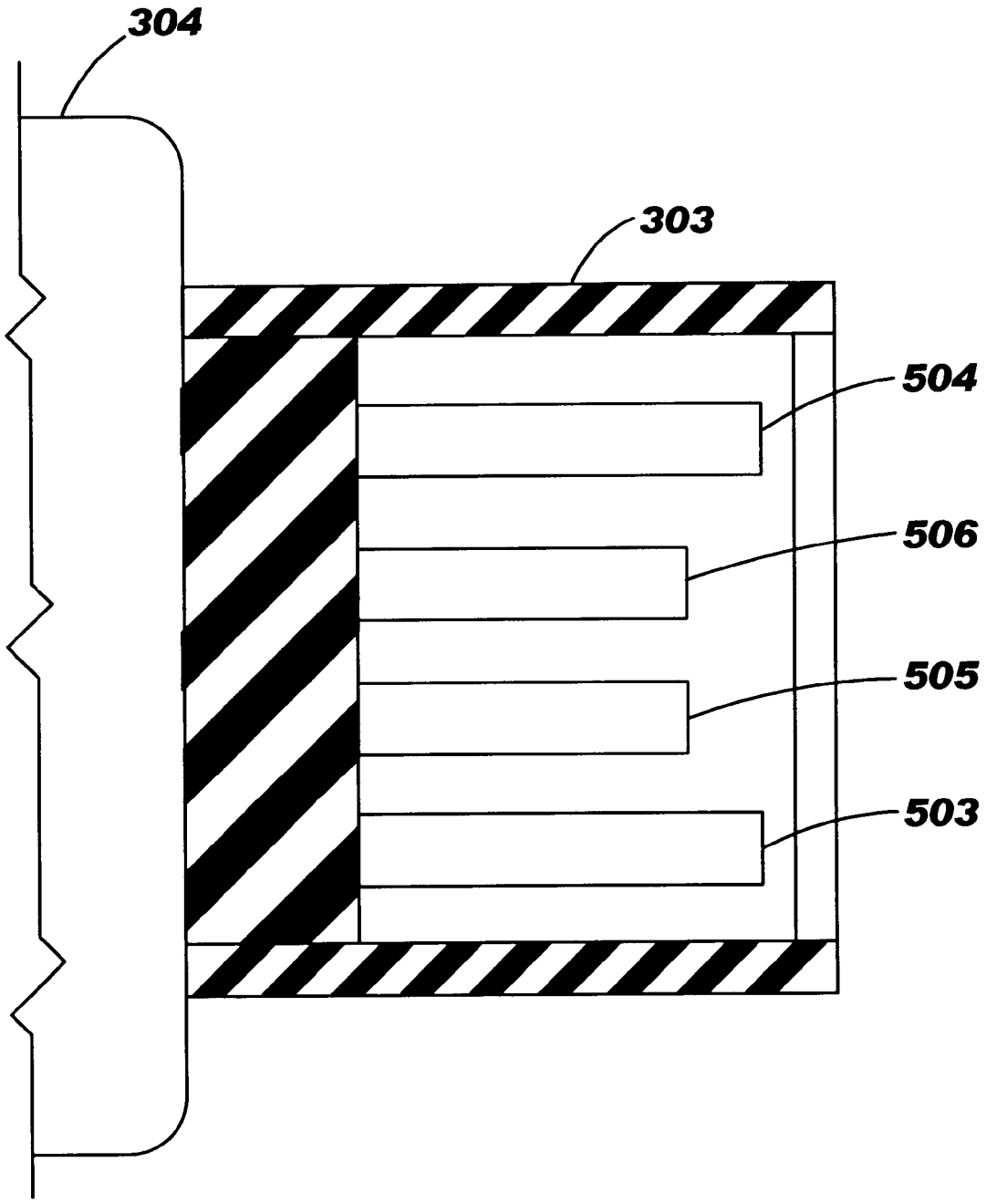

Referring next to FIGS. 5 and 6, there are illustrated two views of standard shielded plug housing 303, which is encased within plug overmold 304. Standard USB signaling is communicated by contacts 503–506.

Figure 7:
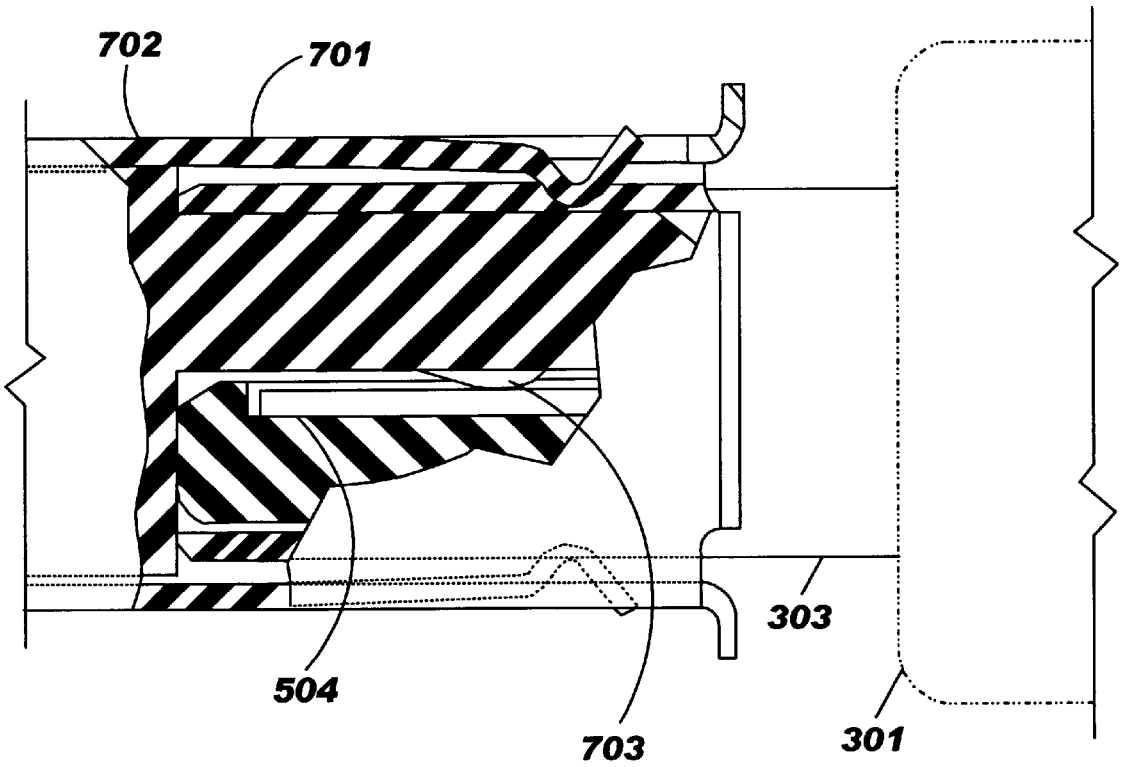

Referring next to FIG. 7, there is illustrated a cross-sectional view of a mating of shielded plug housing 303 with receptacle 701, whereby contact 703 is shown making physical and electrical connection with contact 504 when shielded housing 303 is fully engaged into receptacle 701 at position 702.

Figure 12:
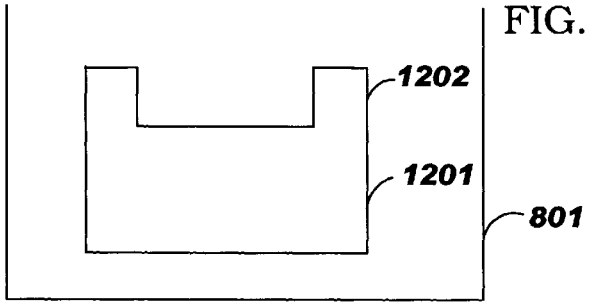
Figure 13:
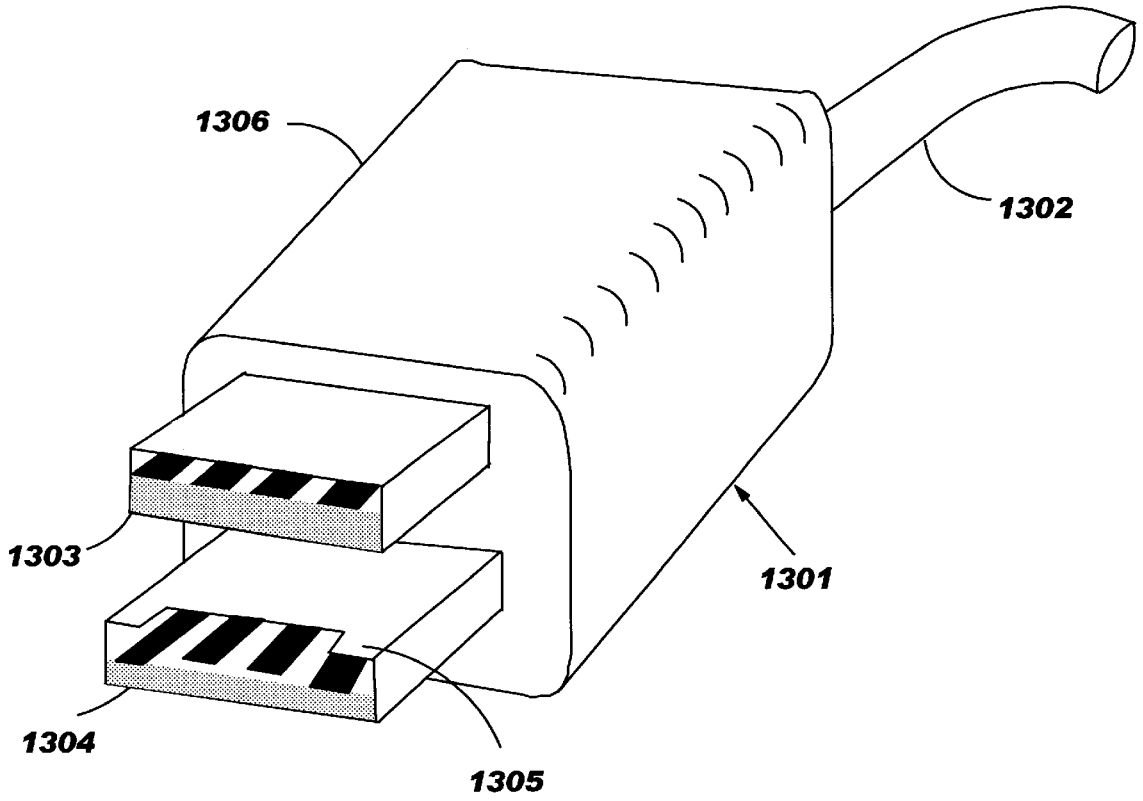
FIG. 13 illustrates an enhanced USB cable plug in accordance with the present invention.

Referring to FIG. 13, plug 1301 further includes a non-standard USB portion 1304, which may communicate non-standard USB signaling, such as auxiliary voltage signals and corresponding ground signals. Plug 1301 has overmold 1306 corresponding to overmold 304, standard USB portion (plug housing) 1303 corresponding to shielded standard portion (plug housing) 303, and bus 1302 corresponding to bus 302, except that additional hardware and parts have been added to implement non-standard USB portion 1304 As will be described below in further detail, housing 1304 includes a housing having cut-out portion 1305, which enables housing 1304 to mate with a standard USB receptacle through specifically designed chassis cut-outs (see FIGS. 8–12).

Also as further noted herein, portions 1303 and 1304 may be swapped in their relative position to each other on plug 1301.

Please note that enhanced plug portion 1304 may be configured in a manner similar to portion 303 illustrated in FIGS. 5 and 6, except that cut-out portion 1305 may also be implemented on housing 1304.

Figure 8:
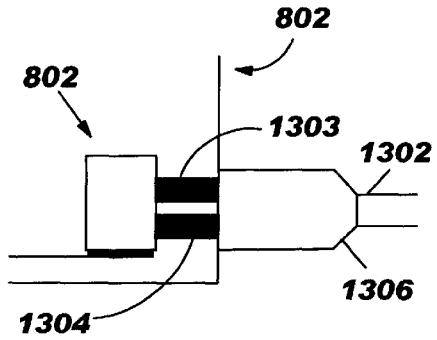
FIG. 8 illustrates an interconnection of an enhanced USB interface.

Referring next to FIG. 8, there is illustrated a USB interface whereby plug 1301 having portions 1303 and 1304 is mated with USB receptacle 802, which is coupled to circuit card 803, which may be implemented within any of the devices shown in FIG. 2. Receptacle 802 and circuit card 803 are enclosed within chassis 801.

In order that portions 1303 and 1304 may mate with receptacle 802, cut-out portions, or holes, are required within chassis 801. This is further illustrated in FIGS. 9–12 in various embodiments.

Figure 9:
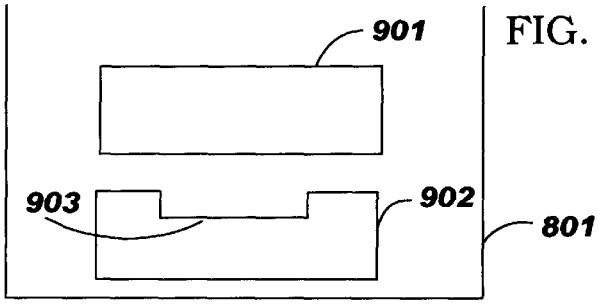
FIGS. 9–12 illustrate various keying configurations in accordance with the various embodiments of the present invention.

In FIG. 9, chassis 801 has holes 901 and 902 stamped therein. Hole 902 has a key 903 so that only portion 1304 of plug 1301 may be coupled through hole 902 into receptacle 802, since portion 1304 includes cut-out 1305. Hole 901 is adaptable for receiving plug portion 1303.

Figure 10:
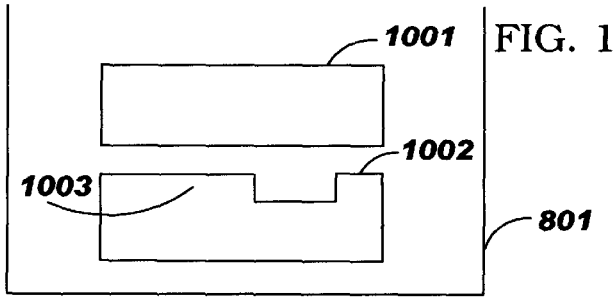

FIG. 10 illustrates an alternative embodiment of the present invention whereby hole 1001 within chassis 801 is adaptable for receiving standard USB plug portion 1303 while hole 1002 has an off-set key 1003, so that the enhanced portion 1304 may only mate through hole 1002 in a particular manner, which may be implemented for insuring that a polarized connection is properly coupled. The required cut-out in portion 1304 is not shown but could be implemented by one skilled in the art viewing the illustration in FIG. 10.

Figure 11:
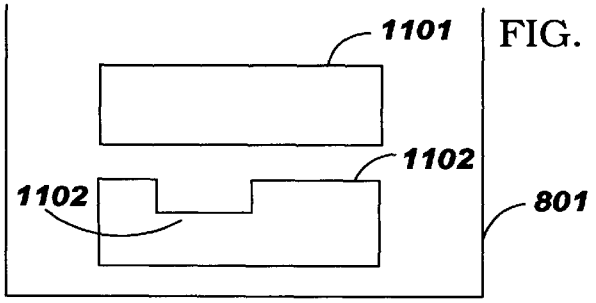

Likewise, FIG. 11 shows a left polarizing key tab cut-out 1103 in hole 1102.

FIG. 12 shows another alternative embodiment of the present invention whereby hole 1201 has key 1202. Hole 1201 is thus adaptable for receiving plug 1301 where portions 1303 and 1304 have been swapped (see FIG. 4).

Figure 4:
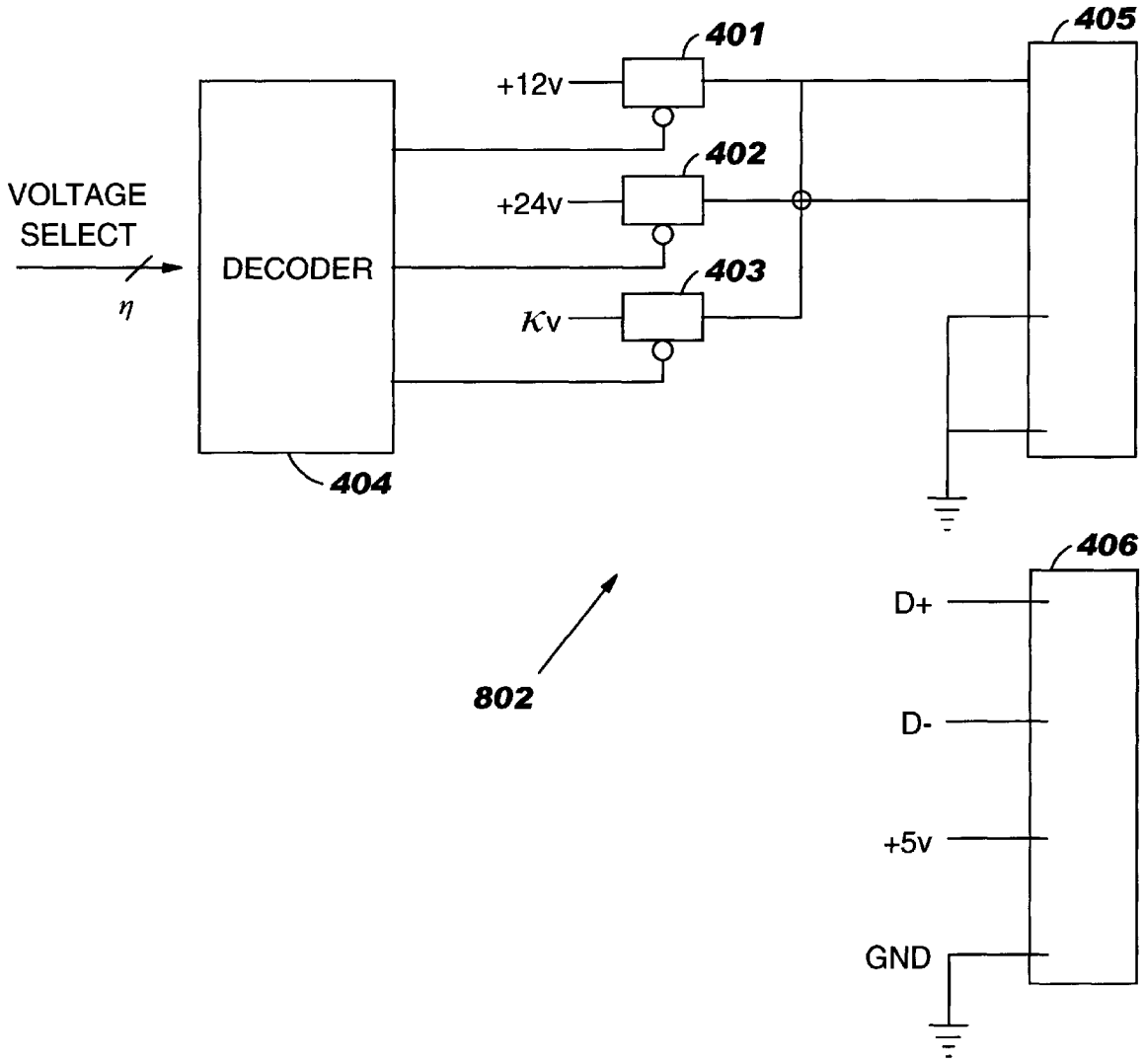
FIG. 4 illustrates exemplary signaling provided within an enhanced USB connection.

Referring next to FIG. 4, there is illustrated a possible embodiment for connector 802 whereby connector section 406 is operable for receiving standard USB portion 1303, while connector section 405 is operable for receiving enhanced USB portion 1304. Note, the configuration shown in FIG. 4 may correspond to a plug configuration whereby portions 1303 and 1304 have been swapped, as described above with respect to FIG. 12.

Connector section 406 operates to communicate the differential data signals D+ and D− and the 5-volt and ground signaling. Connector section 405 operates to communicate ground signaling and alternative voltage signals, which are switched into place by voltage switches 401–403 as in the example shown in FIG. 4. Decoder 404, which is selectable by the voltage select signal (under control of the hub) operates to control voltage switches 401–403.

Although the present invention and its advantages have been described in detail, it should be understood that various changes, substitutions and alterations can be made herein without departing from the spirit and scope of the invention as defined by the appended claims.

What is claimed is:

1. A receptacle adaptable for interfacing with an enhanced Universal Serial Bus ("USB") connector and cable, said receptacle comprising:

a first socket having a structure of electrical connections for providing standard USB signaling when coupled to a USB connector; and a second socket having a structure of electrical connections for providing alternative signaling other than said standard USB signaling when coupled to an alternative connector, wherein the enhanced USB connector comprises the USB connector and the alternative connector.

2. The receptacle as recited in claim 1, wherein said alternative signaling includes an auxiliary voltage different from any voltage carried by said standard USB signaling.

3. An apparatus adaptable for interfacing with an enhanced Universal Serial Bus ("USB") connector and cable, said apparatus comprising:

first circuitry providing standard USB signaling;

a first socket, coupled to said first circuitry, for interfacing with a USB connector to thereby transfer said standard USB signaling to the USB connector;

second circuitry providing alternative signaling other than said standard USB signaling; and a second socket, coupled to said second circuitry, for interfacing with an alternative connector to thereby transfer said alternative signaling from said second circuitry to said alternative connector.

4. The apparatus as recited in claim 3, wherein said alternative signaling includes an auxiliary voltage different from any voltage carried by said standard USB signaling.

5. The apparatus as recited in claim 3 further comprising means for preventing said USB connector from coupling with said second socket.

6. The apparatus as recited in claim 5 wherein said preventing means is a keyed hole in a chassis containing said first socket.

7. The apparatus as recited in claim 6, wherein said alternative connector is configured so that said keyed hole permits passage of said alternative connector therethrough in order to mate with said second socket.

8. The apparatus as recited in claim 7, wherein said keyed hole permits only a polarized coupling of said alternative connector with said second socket.

* * * * *